US005615778A

United States Patent [19]

Kaiser et al.

[11] Patent Number: 5,615,778

[45] Date of Patent: Apr. 1, 1997

[54] PROCESS TO SORT WASTE MIXTURES

[75] Inventors: Dieter Kaiser, Dortmund; Franz Wintrich, Essen, both of Germany

[73] Assignee: RWE Entsorgung Aktiengesellschaft, Essen, Germany

[21] Appl. No.: 30,404

[22] PCT Filed: Jul. 27, 1992

[86] PCT No.: PCT/DE92/00627

§ 371 Date: Jun. 4, 1993

§ 102(e) Date: Jun. 4, 1993

[87] PCT Pub. No.: WO93/02813

PCT Pub. Date: Feb. 18, 1993

[30] Foreign Application Priority Data

Jul. 29, 1991 [DE] Germany ..... 41 25 045.1

[51] Int. Cl.[6] ..... B07C 5/00

[52] U.S. Cl. ..... 209/578; 209/587; 209/939; 209/590

[58] Field of Search ..... 209/539, 587, 209/576, 939, 536, 578, 590, 644

[56] References Cited

U.S. PATENT DOCUMENTS

| | | | |
|---|---|---|---|
| 2,898,801 | 8/1959 | Rockafellow . | |
| 2,999,587 | 9/1961 | Campbell | 209/539 |
| 3,028,960 | 4/1962 | Currie et al. . | |
| 3,179,247 | 4/1965 | Hutter et al. . | |
| 3,327,850 | 6/1967 | Simmons | 209/644 X |
| 3,356,211 | 12/1967 | Mathews | 209/578 X |
| 3,650,400 | 3/1972 | Warren et al. | 209/578 X |
| 3,661,258 | 5/1972 | Madalo et al. | 209/578 |
| 4,352,431 | 10/1982 | Artiano . | |
| 4,360,539 | 11/1982 | Sachtleben et al. | 209/578 X |
| 4,493,420 | 1/1985 | Dennis | 209/587 |
| 4,576,286 | 3/1986 | Buckley et al. | 209/590 X |
| 4,872,024 | 10/1989 | Nagai et al. | 209/939 X |
| 4,924,088 | 5/1990 | Carman et al. | 209/578 X |
| 4,976,356 | 12/1990 | Mizuno et al. | 209/939 X |
| 5,013,905 | 5/1991 | Neri | 209/536 X |
| 5,020,675 | 6/1991 | Cowlin et al. | 209/939 X |
| 5,085,325 | 2/1992 | Jones et al. | 209/939 X |
| 5,125,514 | 6/1992 | Oehler et al. | 209/576 X |
| 5,134,291 | 7/1992 | Rhul, Jr. et al. | 209/587 X |
| 5,135,113 | 8/1992 | Mayer et al. | 209/539 |
| 5,141,110 | 8/1992 | Trischan et al. | 209/587 X |

FOREIGN PATENT DOCUMENTS

| | | | |
|---|---|---|---|
| 3520486 | 7/1988 | Germany . | |
| 9105220 | 4/1991 | WIPO | 209/590 |

*Primary Examiner*—D. Glenn Dayoan
*Attorney, Agent, or Firm*—Connolly & Hutz

[57] ABSTRACT

The present invention relates to a process to sort waste mixtures by irradiating the waste objects with electromagnetic and/or acoustic waves, by picking up the waves emanating from each irradiated waste object in a signal processor to identify it, and by transmitting signals from the signal processor to a separator which sorts out the identified waste object.

4 Claims, 1 Drawing Sheet

PROCESS TO SORT WASTE MIXTURES

BACKGROUND OF THE INVENTION

1. Field of the Invention

This invention relates to a process for sorting mixtures of discarded, unsorted waste objects such as films, cups, bottles, and foams made of plastic, carton packaging made of composites for liquid food products, aluminum foil packages, and other unsorted waste objects. An aspect of this process relates to identification of various types of objects, followed by a sorting step. Another aspect of this process relates to the use of a form of radiation to aid in the identification step. Still another aspect of this invention relates to an apparatus for sorting out mixtures of waste objects. An aspect of this device relates to the use of a radiation source.

2. Description of the Prior Art

The recovery of re-usable materials from waste is becoming increasingly important in industry as well as in households. In this context, special mention should be made of the German Dual System, according to which packaging materials and packaging products are collected separately in special bins in households; participating businesses guarantee that they will accept all of the material collected and that they will re-use this material.

This collection results in a mixture of materials such as films, cups, bottles and foams made of plastic, carton packaging made of composites for liquid food products and metal packaging materials made, for example, of tinfoil or aluminum.

When it comes to recycling, the more completely sorted the recovered material, the higher the quality of the products made of such materials. Therefore, further development of the sorting technology is a decisive factor for the successful implementation of the Dual System.

Even though intensive development work is under way in the realm of sorting technology, it is not yet possible to sort out, for example, the individual components from a mixture of chemically related plastics such as polyethylene and polypropylene. Another problem involves the fillers and additives contained in the plastics, since they cause substantial changes in the properties of the pure plastic.

A known example from the state of the art is the AKW process, according to which heavy plastics such as polystyrene and polyvinyl chloride are separated in hydrocyclones from the light-weight fraction consisting of polyethylene and polypropylene (AKW-Apparate+Verfahren GmbH, address: Georg-Schiffer-Strasse 70, 8452 Hirschau, Germany).

SUMMARY OF THE INVENTION

Surprisingly, this invention is better able to provide reliable and economic separation of individual waste components or waste objects in a waste mixture comprising a multiplicity of waste objects or components by means of a process comprising:

detecting characteristic features of the waste objects by irradiating the objects (exposing these waste objects to electromagnetic and/or acoustic waves), then identifying the waste objects by processing the waves emanating from each waste object by means of an electronic signal processor, and then via the electronic signal processor, transmitting signals to a separator that sorts out the identified waste object from the mixture.

To carry out the process described above, this invention utilizes an apparatus for sorting out waste mixtures into individual waste objects or components, which apparatus comprises:

a radiation source for electromagnetic and/or acoustic waves housed within the apparatus and, optionally, a wave pickup device (receiver) to pick up the waves emanating from the waste object, an electronic signal processor for identifying the waste objects, and a separator for sorting out the thus-identified objects which separator is controlled by outgoing signals from the signal processor.

In the case where the objects are identified by radiation from the visible light portion of the electromagnetic radiation spectrum, the apparatus is similar to that described above in that it has the signal processor to identify the objects by processing the waves emanating from the waste objects, as well as a separator controlled by the signals emitted from the signal processor in order to sort out the identified waste objects, but it optionally includes a device such as a video camera to pick up the waves emanating from the waste object.

BRIEF DESCRIPTION OF THE DRAWINGS

In the Drawings, wherein like reference numerals denote like parts in both of the Figures.

DETAILED DESCRIPTION

The goals of this invention are generally achieved in that, as a result of the process according to the invention and of the device according to the invention, at least one or more characterizing features of a waste object are detected and then evaluated in such a manner that it becomes possible to identify the waste object, after which a separator is activated which then sorts out the identified object. Examples of such characterizing features are the external shape of the object such as, for instance, the shape of bottles, cups, tubes, cubic shapes and other shapes, as well as characteristic lettering, product names, company or manufacturer names, trademarks, colors and the like, which are present on the object.

The electronic signal processor is not only capable of identifying and sorting out waste objects according to the features mentioned, but in addition, on the basis of the data stored, it can also evaluate the features in such a way that it becomes possible to categorize the material that makes up the waste object, for example, to ascertain on the basis of a cup form—optionally linked with other features such as manufacturer's name and product name—that it is an object made of polystyrene. After completion of the identification, the signal processor transmits the information to a separator which then carries out the actual sorting of the identified object.

Figure 1:
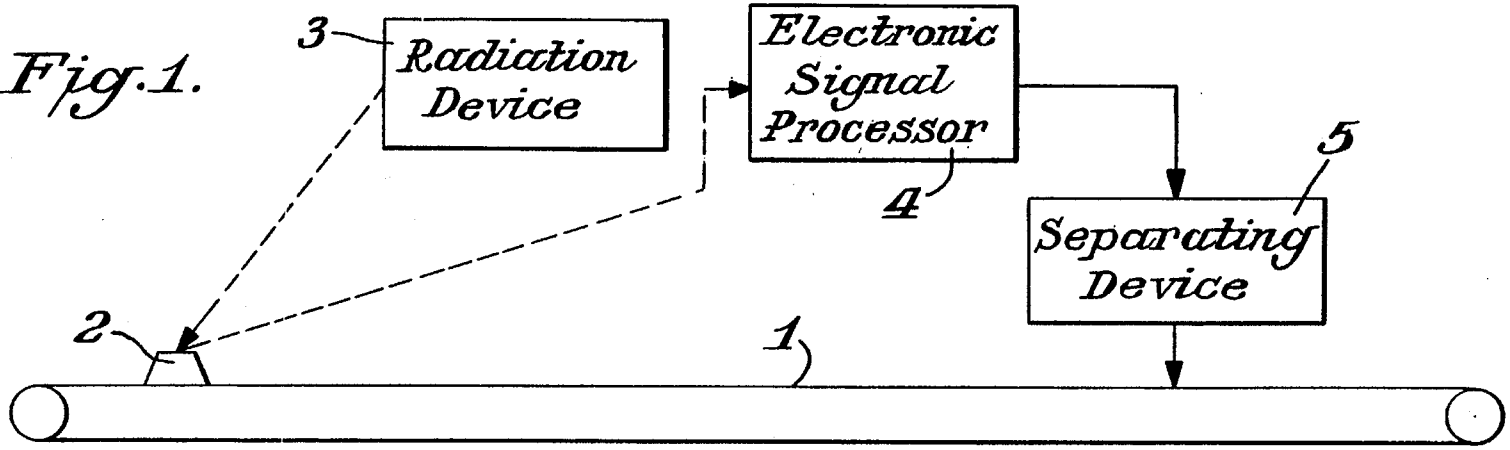
FIG. 1 is a schematic representation of an apparatus for sorting waste mixtures into individual waste objects or components in accordance with the principles of this invention, wherein the individual objects are distributed or spread out with the aid of a conveyor belt.
Figure 2:
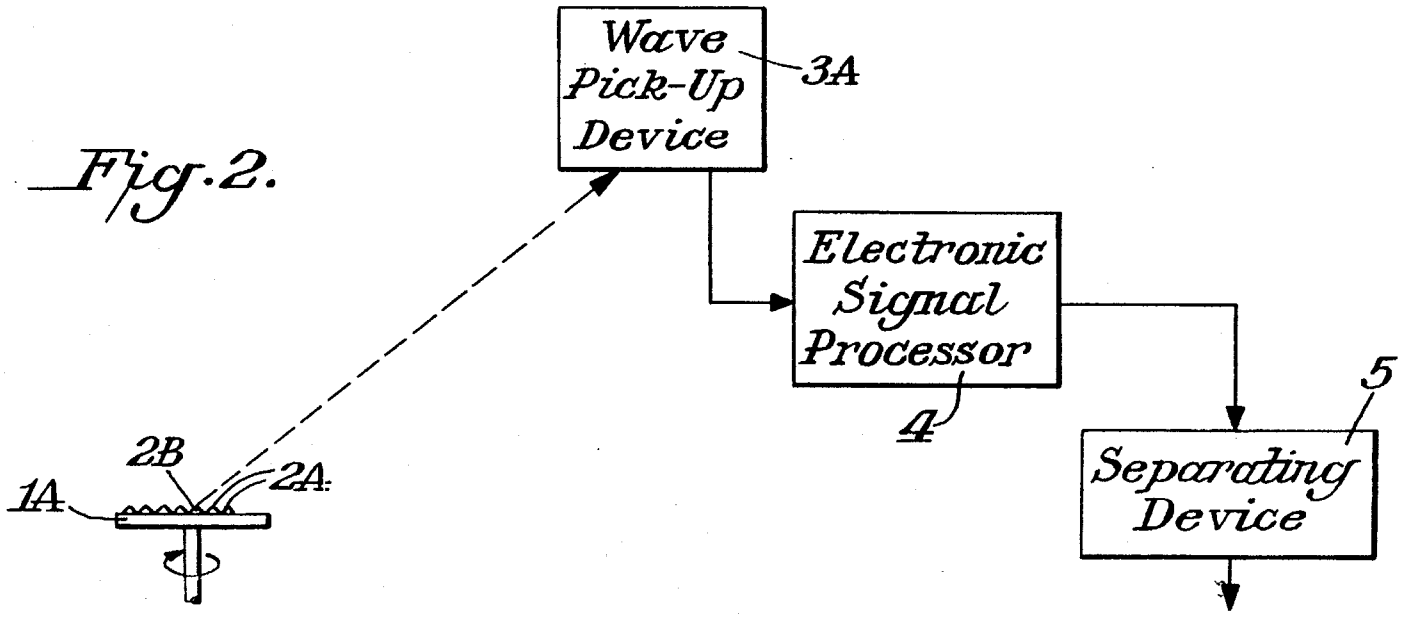
FIG. 2 is a schematic representation of an apparatus for sorting waste mixtures into individual waste objects or components in accordance with the principles of this invention, wherein the individual objects are distributed or spread out with the aid of a rotating distribution disk.

Turning now to the Drawing, which illustrates two preferred embodiments of an apparatus used to carry out the process of this invention, conveyor belt 1 or rotating distribution disk 1A is used to spread out the random mixture of waste objects so that each individual object gets a maximum exposure to visible light radiation or to radiation from a radiation source. FIG. 1 shows a single waste object 2, which is a component of a mixture of waste objects (not shown), on belt 1, approaching radiation device 3 which can be, for example, a source of electromagnetic radiation (UV, IR, etc.) or sound waves. FIG. 2 shows a mixture of waste objects 2A, but the mixture has been spread out or distributed, so that one individual waste object 2B can be irradiated and individually identified. FIG. 2 shows, a scanner or wave pick up device such as a video camera 3A, which can be used to detect or receive (and it may also record) radiation emanating from object 2B (in the case of a video camera the radiation is visible light and is the image or spatial shape of object 2B which is scanned by the video camera); for example, video camera 3A can pick up characterizing features such as external shape, characteristic lettering, trademarks, colors, and the like, present on object 2B. If desired, a still photo camera, a UV (ultraviolet) or IR (infrared) receiver, or a microphone can be substituted for video camera 3A (FIG. 2) to convert the radiation emanating from object 2B into an electronic signal which is transmitted to and then processed by electronic signal processor 4, but it should be understood that signal processor 4 can, if desired, process certain kinds of input directly. In the event that radiation emanating from object 2B is received by the receiving device such as the video camera 3A (FIG. 2), the image of object 2B is converted to an electronic signal by the video camera, and this signal is transmitted from the video camera 3A (FIG. 2) to signal processor 4.

The outgoing signal from signal processor 4 is typically a command or series of commands which controls the operation of the separator or separating device 5. Separating device 5 can carry out the separation of object 2B from the other objects in the mixture 2A (shown in FIG. 2, other objects not shown in FIG. 1) in accordance with principles of mechanical, pneumatic, hydraulic, or electrostatic separation. The preferred separating device 5 is mechanical or pneumatic, e.g. a jet of air which removes objects from the belt, propelling one type of object in one direction and a different type of object in a different direction.

The preferred mode of operation of the apparatus shown in the Drawing will be readily apparent from the following description.

In the process according to the invention, the waste object first has to be exposed to electromagnetic waves or sound waves or else to both types of waves.

The waves that either are reflected from or else penetrate the waste object are picked up by the electronic signal processor or else first picked up by a preceding device such as, for instance, a video camera, another camera, a device suitable for recording still pictures or, in the case of sound waves, a microphone or another sound-sensitive device. These devices transmit the signals to the actual electronic signal processor. The waves employed to identify the waste object are generally or primarily reflected beams which result from the radiation, or else beams which have penetrated the object. Less significant waves are those which occur due to secondary radiation such as, for example, thermal radiation, which an object that had been heated subsequently emits as IR rays.

In principle, the entire electromagnetic spectrum as well as all acoustic waves can be used according to the invention. Preference is given to visible light, IR rays, UV rays and sound waves.

The separator can sort the identified waste objects in any desired manner from the waste mixture. As indicated previously in the description of the Drawing, mechanical or pneumatic separators are preferred, but other separation means (hydraulic, electrostatic, etc.) can be employed according to the invention.

Sources of radiation and signal processors are known to the person skilled in the art. Therefore, there is no need to elaborate on these aspects of the detection and identification steps of the process.

Throughout this specification, the terms "waste object" and "component in (or from) a waste mixture" are used interchangeably. It will be apparent from the foregoing description that the process and apparatus of this invention are capable of a very advanced type of separation in which, for example, a component of the waste mixture consisting essentially of one type of plastic can be separated from a component of the mixture consisting essentially of a different type of plastic.

Various modifications of the process and the apparatus described above will occur to those skilled in the art.

What is claimed is:

1. A process for sorting a waste mixture after sufficient distribution of the waste mixture on a conveyor belt, said process comprising:

exposing characteristic features of each waste object to light wave radiation, said characteristic features being detectible with light wave radiation and including a shape, a color, and any characteristic markings, including lettering, scanning each object with a video camera, which receives light wave radiation emanating from each object, for said characteristic features, and receiving an image of each waste object, which image includes said characteristic features, identifying each waste object by said characteristic features and transmitting a signal from the video camera to an electronic signal processor having stored data with respect to said characteristic features, said electronic signal processor being responsive to said signal from the video camera, processing the signals from the video camera with the electronic signal processor on the basis of said data, and categorizing the material of which each waste object is comprised, transmitting a signal from the electronic signal processor to a pneumatic separator means, responsive to said signal from said signal processor, said pneumatic separator means including air jet means for removing objects from the conveyor belt by propelling one type of object in one direction and a different type of object in a different direction.

2. The process according to claim 1, wherein said light wave radiation comprises visible light waves.

3. The process according to claim 1, wherein the waste mixture is distributed on the conveyor belt to spread out the waste mixture to the extent that individual waste objects can be detected to the greatest possible extent by the light wave radiation.

4. The process according to claim 1, wherein the waste mixture comprises waste objects consisting essentially of different types of plastic, wherein each said waste object is identified by type of plastic, and wherein waste objects consisting essentially of one type of plastic are separated from waste objects consisting essentially of a different type of plastic.

* * * * *